United States Patent [19]

Bourgeois

[11] 4,144,161

[45] Mar. 13, 1979

[54] ELECTROLYTIC DIAPHRAGM CELL

[75] Inventor: Louis Bourgeois, Brussels, Belgium

[73] Assignee: Solvay & Cie, Belgium

[21] Appl. No.: 783,823

[22] Filed: Apr. 1, 1977

[30] Foreign Application Priority Data

Apr. 26, 1976 [FR] France ..... 76 12489

[51] Int. Cl.[2] ..... C25B 15/00

[52] U.S. Cl. ..... 204/229; 204/266; 204/278

[58] Field of Search ..... 204/266, 256, 257, 258, 204/263, 269, 270, 228-230, , 275, 278

[56] References Cited

U.S. PATENT DOCUMENTS

| | | | |
|---|---|---|---|
| 1,898,352 | 2/1933 | Enzor | 204/258 |
| 2,011,171 | 8/1935 | Baker | 204/266 X |
| 2,183,299 | 12/1939 | Stuart | 204/266 |
| 2,695,874 | 11/1954 | Zdansky | 204/258 |
| 3,910,831 | 10/1975 | Helart | 204/258 X |

*Primary Examiner*—Charles F. LeFevour

*Attorney, Agent, or Firm*—Robert E. Burns; Emmanuel J. Lobato; Bruce L. Adams

[57] ABSTRACT

An electrolytic cell having an anode compartment and a cathode compartment separated by a porous diaphragm. The cell has inlet and outlet pipes for electrolyte. A valve controls the supply of electrolyte. A gas outlet-pipe is connected to the anode compartment or to the cathode compartment. A valve is disposed in the gas outlet-pipe and is variable as to its opening. A vessel in the cell has an upper part thereof in communication with the gas outlet-pipe upstream of the valve and a lower part of the vessel is in communication with the compartment to which the gas outlet-pipe is connected. A float in the vessel is operatively connected with the valve in the gas outlet-pipe and progressively closes as it rises and opens the valve as it moves downwardly in response to electrolytic height variations. The valve is in an intermediate, partially closed position during normal operation of the cell during which the cell is partially filled with electrolyte.

10 Claims, 3 Drawing Figures

ELECTROLYTIC DIAPHRAGM CELL

BACKGROUND OF THE INVENTION

The present invention relates to electrolytic cells with pervious diaphragms for the production of a gas, in particular cells for the electrolysis of aqueous solutions of alkali metal chloride.

A major difficulty met with in the operation of diaphragm cells lies in the need to adjust the running of the cells to variations in the electrolysing current. When operating, the cells are in fact subjected to large periodic variations in the electrolysing current, necessitated for example by variation in the cost of electric power from the supply grid or, more generally, by economic considerations which compel industry to reduce its electrical consumption during the period of the day where domestic comsumption is large.

Experience has shown that variations in the electrolysing current density often cause serious disturbances in the operation of diaphragm cells, particularly an acceleration in the swelling of asbestos diaphragms, if certain precautions are not observed.

So as to avoid premature swelling of the asbestos diaphragms of electrolytic cells, it is proposed, in Belgian Pat. No. 711 791 of Mar. 7, 1968, in the name of Imperial Chemical Industries Ltd, to maintain the percolation rate of the electrolyte through the diaphragms substantially proportional to the electrolysing current density at all times during operation of the cell. In order to do this the pressure of a gas produced in the anode compartment or in the cathode compartment of the cell is adjusted. For this purpose, the cell is provided with a valve of variable aperture, which partially restricts an off-take pipe for the gas when the cell is operating under a nominal current density. If the electrolyzing current density falls, a proportional reduction is made in the electrolyte feed and the aperture of the valve is altered so as to alter the gas pressure in the cell and thus immediately adjust the electrolyte percolation rate through the diaphragm so that it remains at all times proportional to the electrolysing current density.

SUMMARY OF THE INVENTION

The applicant has now found an improved diaphragm cell, devised for reacting automatically and rapidly to a variation in the electrolysing current density and/or in the electrolyte feed rate, so as to maintain the relationship between the rate of flow of the electrolyte through the diaphragm and the electrolysing current density substantially constant at all times.

The invention therefore provides an electrolytic diaphragm cell, comprising an anode compartment and a cathode compartment separated by a diaphragm, an inlet pipe and an outlet pipe for an electrolyte, means for controlling the feed of electrolyte, an outlet pipe for a gas produced in the anode compartment or in the cathode compartment and a valve of variable aperture placed in the gas outlet pipe, and in addition provided with means for operating the valve comprising a float placed in a vessel that is in communication at its upper part with the gas outlet pipe, upstream of the valve, and at its lower part with the compartment that is connected to the said gas outlet pipe.

In the cell according to the invention, the valve is designed so that in normal operation it occupies a position in which it partially constricts the gas outlet pipe, the cell being fed with electrolyte at a nominal rate. The valve is joined to the float by a connecting device designed for progressively opening or closing the valve as the float falls or rises in the vessel. Thus, if the current density falls, the gas pressure in the compartment where it is produced by electrolysis drops immediately and, as a consequence, the rate of flow of the electrolyte through the diaphragm changes immediately and proportionally. While the rate of feed of electrolyte into the cell is being altered so that it matches the new value of the current density, the level of electrolyte in the compartment will fluctuate thus operating the valve so that this level will finally become stabilised at a position which will depend on the permeability of the diaphragm and the gas pressure in the compartment, upstream of the valve.

In the cell according to the invention, the compartment (anodic or cathodic) which is connected to the gas conduit containing the valve may be extended above the normal electrolyte level in the said compartment so as to form the so-called vessel containing the float.

As a modification, the vessel may form a cavity separate from the anode and cathode compartments of the cell.

In a particularly advantageous embodiment of the cell according to the invention, the vessel containing the float forms a cavity separate from the anode and cathode compartments and is united with the compartment that is connected to the gas conduit containing the valve, in a zone of this compartment where there is no gas liberation in the electrolyte. In this embodiment of the cell according to the invention, the electrolyte present in the vessel containing the float is not the seat of gas evolution, so that its apparent specific gravity is independent of the running of the cell and is equal to its true specific gravity.

The invention applies equally well to cells with horizontal diaphragms, for example those of the type described and claimed in Belgian Pat. Nos. 781 959 of Apr. 12, 1972 and 787 989 of Apr. 10, 1973, both in the name of the present applicant, and to cells with vertical diaphragms, for example those of the type described and claimed in Belgian Pat. Nos. 726 223 of Dec. 30, 1968; 780 912 of Mar. 20, 1972 and 806 280 of Oct. 19, 1973, all in the name of the present applicant.

BRIEF DESCRIPTION OF THE DRAWINGS

Special features and details of the invention will become apparent from the description of the appended figures, which represent three particular embodiments of the cell according to the invention.

DESCRIPTION OF THE PREFERRED EMBODIMENTS

Figure 1:
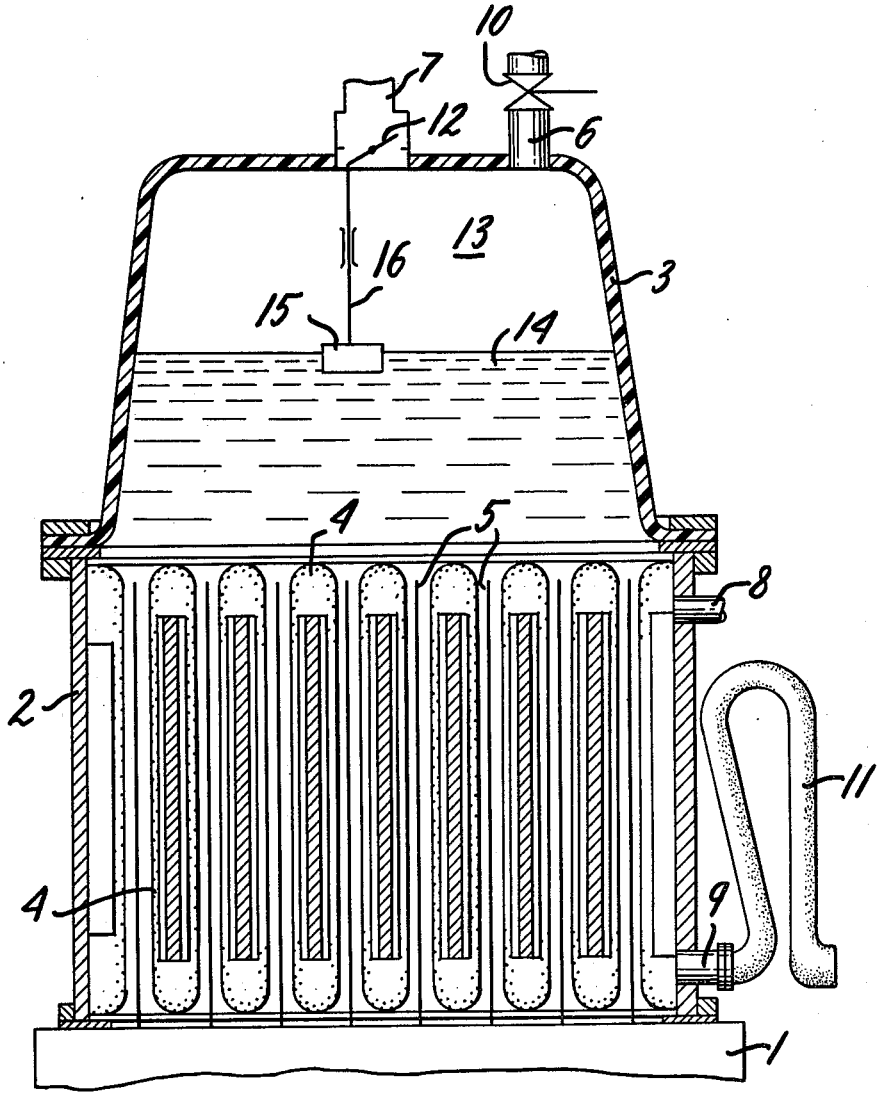
FIG. 1 is a transverse vertical view of, a first embodiment of the invention, applied to a cell with vertical electrodes.

In these figures identical elements are denoted by the same reference numerals.

In FIG. 1 is shown a diaphragm cell with vertical electrodes of the type described for example in the aforesaid Belgian Pat. Nos. 726 223; 780 912 and 806 280 and suitable for the electrolysis of a sodium chloride brine.

The cell comprises a foundation 1 forming the so-called base of the cell and supporting, at its periphery, a rectangular casing 2 made of steel, closed by a cover 3. Within the casing 2, cathodes 4 alternate with rows of substantially vertical and parallel anode plates 5 passing through the base of the cell and connected beneath the base, to a current lead-in (not shown).

The anodes 5 are for example constituted by plates of graphite or, preferably plates of titanium carrying on their two surfaces a coating as is known in the art, which is resistant to the conditions ruling in the cell and which catalyses the discharge of chloride ions at the anodes. By way of example, the coating on the anodes may comprise a metal of the platinum group or a compound, for example an oxide, of a metal of the platinum group.

The cathodes 4 are formed by a steel lattice, fixed to the walls of the casing 2 and shaped so as to form cathode pockets extending between the anodes 5. The cathode lattice 4 is covered entirely on its surface facing towards the anodes by a diaphragm (not shown), which thus separates the cell into a cathode compartment and an anode compartment.

The anode compartment is in communication, by way of the cover 3, with a pipe 6 for feeding-in a sodium chloride brine to be electrolyzed and with a pipe 7 for removal of chlorine produced at the anodes 5 during electrolysis.

The cathode compartment is in communication, through the wall of the casing 2, with a pipe 8 for removal of hydrogen produced at the cathodes 4 during electrolysis, and with a pipe 9 for removal of a caustic liquor.

A valve 10, placed in the brine feed pipe, allows the rate at which brine is fed into the cell to be regulated, while an inverted U tube 11, extending from the pipe 9, allows the level of the catholyte in the cathode compartment to be adjusted by rotating the tube 11 around the axis of the pipe 9.

A valve 12 placed in the chlorine conduit 7, allows adjustments of the pressure of chlorine within the vessel 13 delimited beneath the cover 3, above the level 14 of the brine in the anode compartment.

According to the invention, the valve 12 is connected to a float 15 by an actuating linkage 16, so that opening or closing of the valve 12 is automatically brought about by falling or rising of the brine level 14. The position of the valve 12 is set so that it partially closes the pipe 7 during nominal operation of the cell, so that the vessel 13 is then maintained under a pressure of chlorine.

This embodiment of the cell according to the invention allows the operation of the cell to be easily adapted to a fall in the electrolysing current density, so as to maintain substantially constant the ratio V/i between the rate of flow of brine through the diaphragm and the current density. In order to accomplish this, the fall in current density causes an immediate reduction in the pressure of chlorine within the vessel 13 and, as a consequence, a fall in the rate of brine flow through the diaphragm.

By partially closing the valve 10, the rate at which brine is fed into the cell can be reduced to match it with the new current density. The float 15 and the valve 12 then immediately react to this change in the brine feed rate to bring the pressure of chlorine in the vessel 13 to a value which maintains the aforesaid ratio V/i constant.

In a modification, the valve 10 may be automatically moved when the current density alters, for example by being coupled to an ammeter placed in the main current lead to the anodes or to a volt meter connected across the cell terminals.

Figure 2:
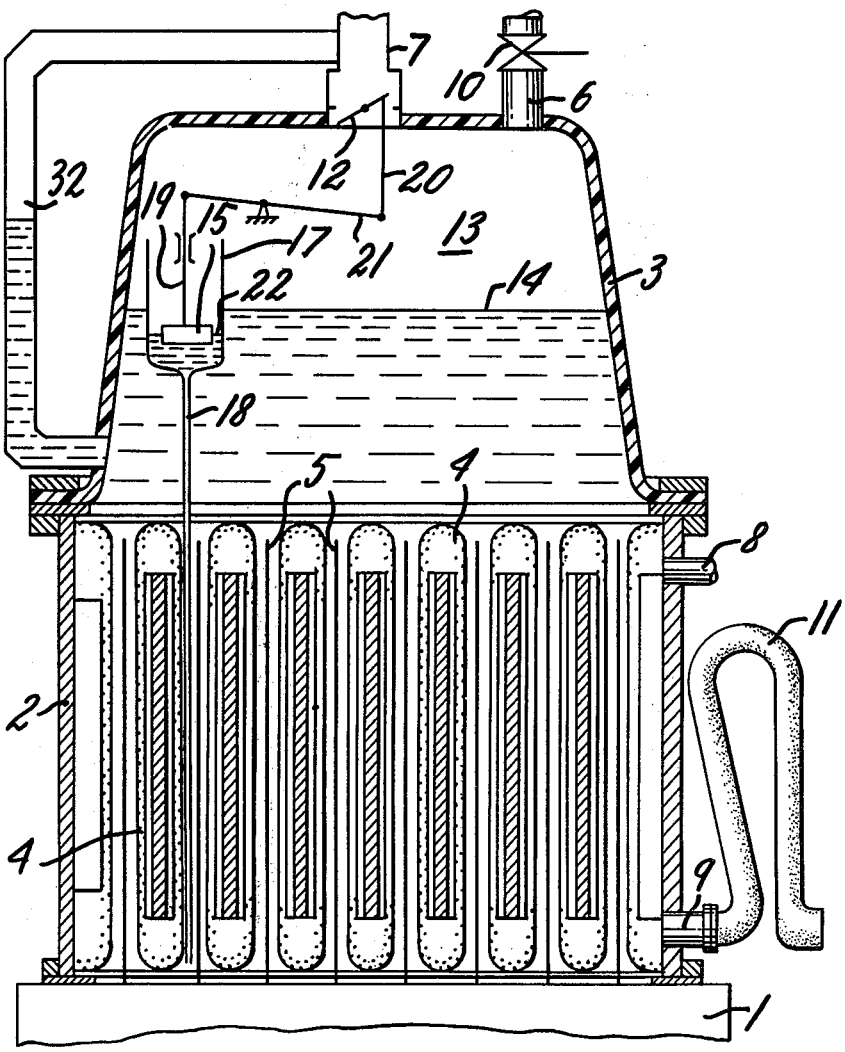
FIG. 2 is a transverse vertical veiw of, a preferred modification of the cell of FIG. 1.

In a modified embodiment of the cell of FIG. 1, shown in FIG. 2, the float 15 is placed in a vessel 17 in the shape of an inverted bell, installed beneath the cover 3 and emerging above the brine level 14. The vessel 17 is open at its upper end and is in communication at its lower end with a tube 18 extending over the whole height of the electrodes and opening into the anode compartment in the immediate vicinity of the base of the cell. The float 15 is connected to the valve 12 by an assembly of articulated arms 19, 20 and a lever 21.

With this specific arrangement of the cell according to the invention the brine contained in the vessel 17 is not the seat of chlorine liberation, in contrast to the bulk of brine contained within the cover, so that its specific gravity is not influenced by the electrolysing current density. It follows that, when the cell is operating, the brine within the vessel 17 takes up a level 22 which is lower than the level 14 within the cover.

As a modification, a tube 32 may connect the pipe 7, downstream of the valve 12, with the anode compartment, in a zone of this compartment close to the upper ends of the electrodes. This modification of the cell prevents the level 14 of the brine in the anode compartment from falling below a critical level, for example in the case of damage in the chlorine evacuation circuit.

Figure 3:
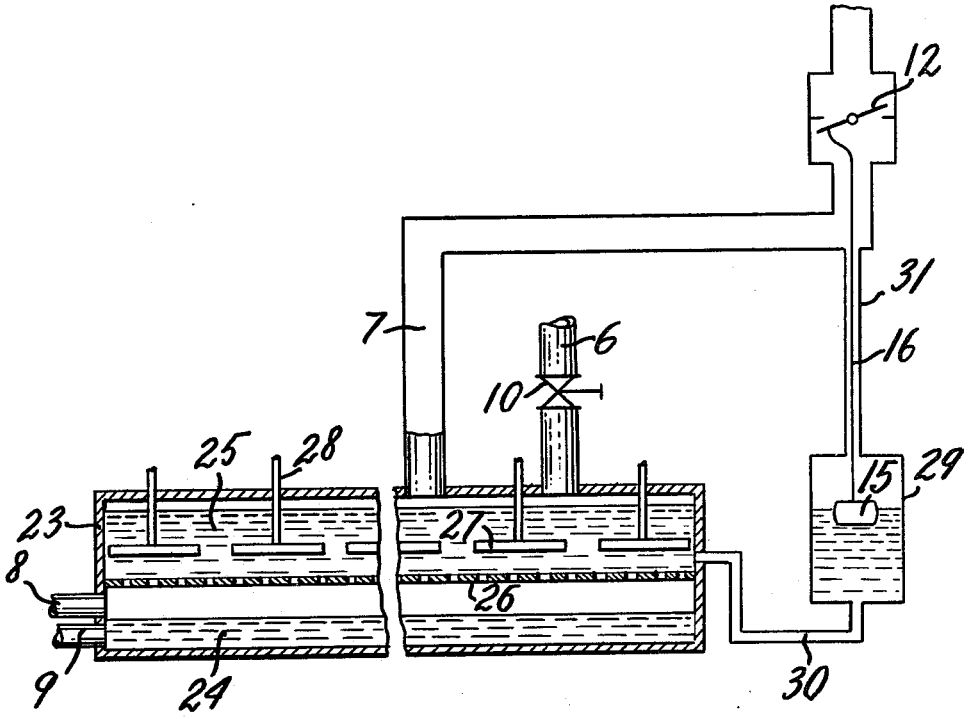
FIG. 3 is a transverse vertical view of, a third embodiment of the invention, applied to a cell with a horizontal diaphragm.

In FIG. 3 is shown an embodiment of the invention applied to a cell with a horizontal diaphragm. This cell comprises a fluid-tight enclosure 23 divided into a lower cathode compartment 24 and an upper anode compartment 25 by a horizontal foraminate cathode 26 carrying a diaphragm (not represented).

The anode compartment 25 contains a series of horizontal anodes 27 suspended above the cathode 26 by rods 28 connected to a current lead-in (not shown). The anode compartment is in communication with a pipe 6 for admission of brine and with a pipe 7 for removal of chlorine produced at the anodes 27.

The cathode compartment 24 is in communication with a pipe 8 for removal of hydrogen produced at the cathode and with a pipe 9 for drawing off a caustic liquor.

A valve 12 of adjustable aperture is installed in the pipe 7, for controlling the pressure of chlorine above the brine level in the anode compartment 25.

In accordance with the invention, the valve 12 is connected to a float 15 placed in a vessel 29 which is situated beside the cell and which is in communication, at its lower end, with a tube 30 opening into the anode compartment 25, below the brine level, and, at its upper end, with a tube 31 opening into the chlorine-removal pipe 7, upstream of the valve 12.

The tube 31 connecting the vessel 29 to the chlorine pipe 7 is advantageously used for passage of the rod 16 connecting the valve 12 to the float 15.

Preferably, the tube 30 opens into the anode compartment 25 beneath the anodes 27, so as to prevent the specific gravity of the electrolyte contained in the vessel 29 from being affected by the liberation of chlorine at the anodes.

In the preceding description of the figures, only the case where the valve 12 is installed in the chlorine off-take pipe has been considered. It is however clear that as a modification the valve 12 may be installed in the hydrogen off-take pipe 8, the vessel containing the float 15 then being connected to the pipe 8, upstream of the valve, and to the cathode compartment.

The invention is clearly not limited to the preceding description, various modifications being possible.

I claim:

1. Electrolytic diaphragm cell, comprising an anode compartment and a cathode compartment separated by a pervious diaphragm, an inlet-pipe and an outlet-pipe for electrolyte, means for controlling the feed of electrolyte, a gas outlet-pipe connected to the anode compartment or the cathode compartment, a valve of variable aperture placed in said gas outlet-pipe, a vessel in communication, at its upper part, with said gas outlet-pipe, upstream of the valve and, at its lower part, with said compartment connected to the gas outlet-pipe, a float located in the vessel and means connecting said valve to said float to progressively close, respectively open, the valve when the float is moved upwardly, respectively downwardly in the vessel, said vessel, float and connecting means being arranged to have the vessel partially filled with electrolyte and the valve in an intermediate partially closed position in normal operation of the cell.

2. Cell according to claim 1, in which the vessel is united with the compartment connected to the said gas pipe in a region of the compartment substantially free from gas evolution.

3. Cell according to claim 2, in which the vessel is connected to a compartment close to the base of the latter.

4. Cell according to claim 1, in which the vessel is disposed within the compartment connected to the gas pipe provided with the valve and opens into the last-mentioned compartment above the maximum level of electrolyte in the last-mentioned compartment.

5. Cell according to claim 1, including a tube open to the compartment connected to said gas outlet pipe, the gas outlet pipe, provided with the valve, being in communication, downstream of the valve, with the tube opening into the compartment connected to the said pipe, above a predetermined minimum level of electrolyte in the same compartment.

6. Cell according to claim 1, in which the diaphragm is substantially vertical.

7. Cell according to claim 6, in which where the cell comprises an alternating sequence of substantially vertical and parallel anode plates and substantially vertical and parallel cathodes in the form of pockets with foraminate walls covered with a diaphragm, the valve is placed in the outlet-pipe for a gas produced in the anode compartment.

8. Cell according to claim 7, in which the vessel is situated within the cell, above the anodes and cathodes, and is extended, at its lower part, by a tube opening close to a baseplate of the cell.

9. Cell according to claim 1, in which the means for controlling the feed of electrolyte comprises a valve installed in the electrolyte inlet-pipe and means for operating the said valve, coupled to an electrical feed circuit of the cell to adjust the aperture of the last mentioned valve to maintain it substantially proportional to the current density in the cell.

10. Cell according to claim 1, in which an aqueous solution of sodium chloride is the electrolyte.

* * * * *